US008841639B2

(12) United States Patent
Yabu et al.

(10) Patent No.: US 8,841,639 B2
(45) Date of Patent: Sep. 23, 2014

(54) CONTROL METHOD FOR TARGET SUPPLY DEVICE, AND TARGET SUPPLY DEVICE

(71) Applicant: Gigaphoton Inc., Tochigi (JP)

(72) Inventors: Takayuki Yabu, Tochigi (JP); Yoshifumi Ueno, Tochigi (JP); Takeshi Kodama, Tochigi (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/024,306

(22) Filed: Sep. 11, 2013

(65) Prior Publication Data

US 2014/0070021 A1 Mar. 13, 2014

(30) Foreign Application Priority Data

Sep. 11, 2012 (JP) ..... 2012-199775

(51) Int. Cl.

| | |
|---|---|
| ***B22D 41/50*** | (2006.01) |
| ***B22D 41/00*** | (2006.01) |
| ***H05G 2/00*** | (2006.01) |
| ***H05H 1/34*** | (2006.01) |

(52) U.S. Cl.

CPC ..... *H05G 2/006* (2013.01); *H05G 2/005* (2013.01)

USPC ..... 250/493.1; 260/504 R; 222/591; 222/595; 378/143

(58) Field of Classification Search

CPC ..... B22D 41/50; B22D 41/00; H05G 2/00; H05H 1/34

USPC ..... 250/491.1, 492.1, 493.1, 504 R; 222/590, 591, 594, 595; 378/119, 125, 378/143

See application file for complete search history.

(56) References Cited

U.S. PATENT DOCUMENTS

| | | | | |
|---|---|---|---|---|
| 6,504,903 | B1 * | 1/2003 | Kondo et al. | 378/119 |
| 6,972,421 | B2 * | 12/2005 | Melnychuk et al. | 250/504 R |
| 7,368,741 | B2 * | 5/2008 | Melnychuk et al. | 250/504 R |
| 7,405,416 | B2 | 7/2008 | Algots et al. | |
| 7,642,533 | B2 * | 1/2010 | Partio et al. | 250/504 R |
| 2010/0176313 | A1 * | 7/2010 | Melnychuk et al. | 250/504 R |
| 2011/0284774 | A1 * | 11/2011 | Ishihara et al. | 250/504 R |
| 2013/0032640 | A1 * | 2/2013 | Yabu et al. | 239/13 |
| 2013/0062538 | A1 * | 3/2013 | Kodama et al. | 250/504 R |
| 2013/0075625 | A1 * | 3/2013 | Yabu et al. | 250/428 |
| 2013/0209077 | A1 * | 8/2013 | Yabu et al. | 392/441 |

* cited by examiner

*Primary Examiner* — Bernard E Souw

(74) *Attorney, Agent, or Firm* — McDermott Will & Emery LLP

(57) ABSTRACT

A control method for a target supply device may employ a target supply device, provided in an EUV light generation apparatus including an image sensor, that includes a target generator having a nozzle and configured to hold a target material and a pressure control unit configured to control a pressure within the target generator, and the method may include outputting the target material in the target generator from a nozzle hole in the nozzle by pressurizing the interior of the target generator using the pressure control unit, determining whether or not a difference between an output direction of the target material outputted from the nozzle hole that is detected by the image sensor and a set direction is within a predetermined range, and holding the pressure in the target generator using the pressure control unit until the difference falls within the predetermined range.

6 Claims, 14 Drawing Sheets

CONTROL METHOD FOR TARGET SUPPLY DEVICE, AND TARGET SUPPLY DEVICE

CROSS-REFERENCE TO RELATED APPLICATION

The present application claims priority from Japanese Patent Application No. 2012-199775 filed Sep. 11, 2012.

BACKGROUND

1. Technical Field

The present disclosure relates to control methods for target supply devices and to target supply devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A control method for a target supply device according to an aspect of the present disclosure may employ a target supply device, provided in an EUV light generation apparatus including an image sensor, that includes a target generator having a nozzle and configured to hold a target material and a pressure control unit configured to control a pressure within the target generator, and the method may include outputting the target material in the target generator from a nozzle hole in the nozzle by pressurizing the interior of the target generator using the pressure control unit, determining whether or not a difference between an output direction of the target material outputted from the nozzle hole that is detected by the image sensor and a set direction is within a predetermined range, and holding the pressure in the target generator using the pressure control unit until the difference between the output direction and the set direction falls within the predetermined range.

A target supply device according to another aspect of the present disclosure may be provided in an EUV light generation apparatus including an image sensor, and the device may include a target generator, a pressure control unit, and a control unit. The target generator may include a nozzle and may be configured to hold a target material. The pressure control unit may be configured to control a pressure in the target generator. The control unit may be configured to control the pressure control unit and output the target material in the target generator from a nozzle hole in the nozzle by pressurizing the interior of the target generator, determine whether or not a difference between an output direction of the target material outputted from the nozzle hole that is detected by the image sensor and a set direction is within a predetermined range, and hold the pressure in the target generator until the difference between the output direction and the set direction falls within the predetermined range.

BRIEF DESCRIPTION OF THE DRAWINGS

Hereinafter, selected embodiments of the present disclosure will be described with reference to the accompanying drawings.

DETAILED DESCRIPTION

Figure 1:
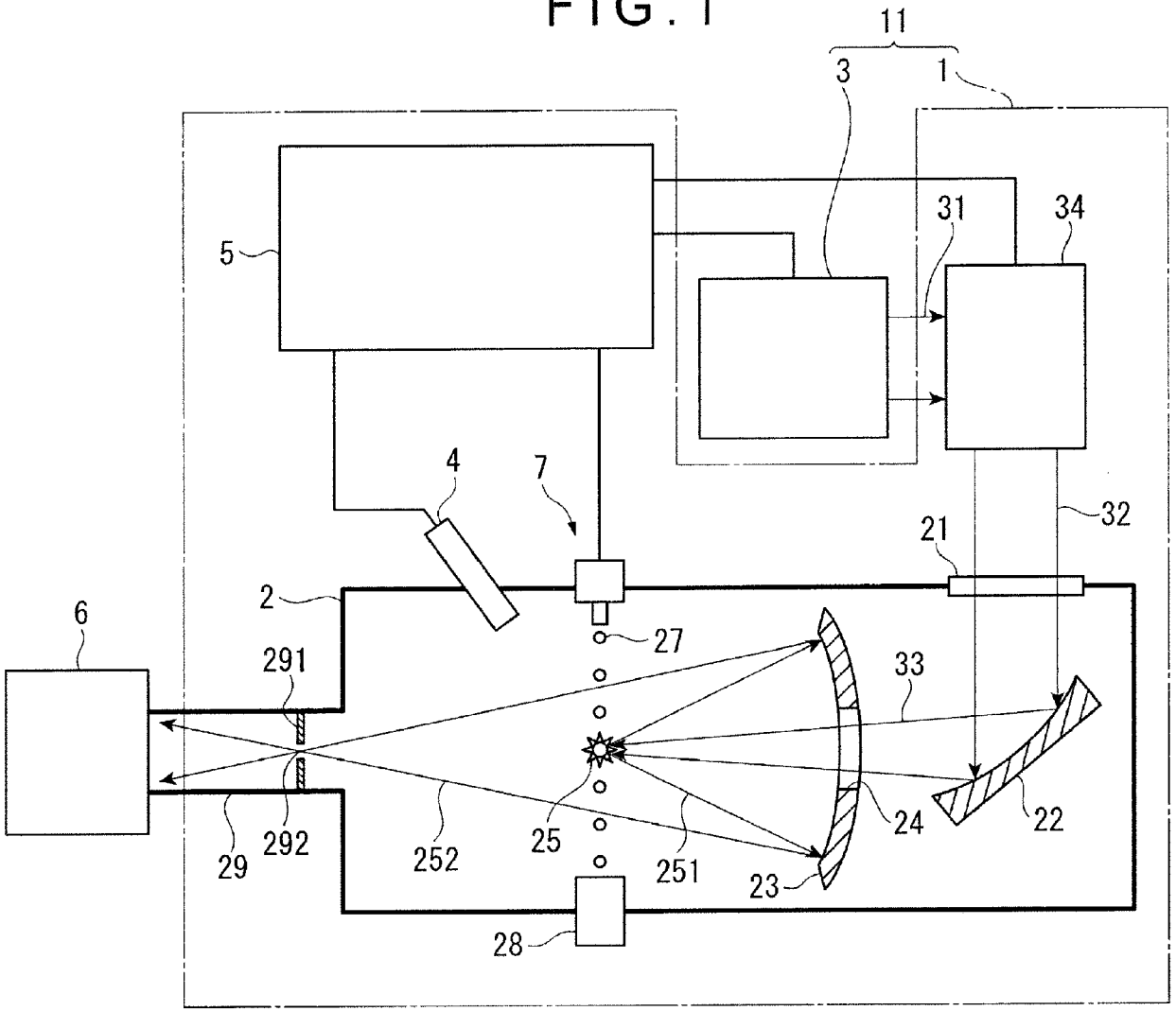
FIG. 1 schematically illustrates an exemplary configuration of an LPP type EUV light generation apparatus.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Overview
2. Overview of EUV Light Generation System
2.1 Configuration
2.2 Operation
3. EUV Light Generation Apparatus Including Target Supply Device
3.1 First Embodiment
3.1.1 Overview
3.1.2 Configuration
3.1.3 Operation
3.2 Second Embodiment
3.2.1 Overview
3.2.2 Configuration
3.2.3 Operation
3.3 Variations

1. Overview

According to an embodiment of the present disclosure, a control method for a target supply device may employ a target supply device, provided in an EUV light generation apparatus including an image sensor, that includes a target generator having a nozzle and configured to hold a target material and a pressure control unit configured to control a pressure within the target generator, and the method may include outputting the target material in the target generator from a nozzle hole in the nozzle by pressurizing the interior of the target generator using the pressure control unit, determining whether or not a difference between an output direction of the target material outputted from the nozzle hole that is detected by the image sensor and a set direction is within a predetermined range, and holding the pressure in the target generator using the pressure control unit until the difference between the output direction and the set direction falls within the predetermined range.

According to an embodiment of the present disclosure, a target supply device may be provided in an EUV light generation apparatus including an image sensor, and the device may include a target generator, a pressure control unit, and a control unit. The target generator may include a nozzle and may be configured to hold a target material. The pressure control unit may be configured to control a pressure in the target generator. The control unit may be configured to control the pressure control unit and output the target material in the target generator from a nozzle hole in the nozzle by pressurizing the interior of the target generator, determine whether or not a difference between an output direction of the target material outputted from the nozzle hole that is detected by the image sensor and a set direction is within a predetermined range, and hold the pressure in the target generator until the difference between the output direction and the set direction falls within the predetermined range.

2. Overview of EUV Light Generation System

2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 292 may be provided in the connection part 29. The wall 291 may be positioned such that the second focus of the EUV collector mirror 23 lies in the aperture 292 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation Apparatus Including Target Supply Device

3.1 First Embodiment

3.1.1 Overview

In a control method for a target supply device according to a first embodiment of the present disclosure, the output of the target material in the target generator from the nozzle hole in the nozzle may be carried out by outputting the target material as a jet, and the determination as to whether or not the difference between the output direction of the target material and the set direction is within the predetermined range may be carried out by determining whether or not a difference between a trajectory of the target material outputted as a jet and a set trajectory is within a predetermined range.

In a target supply device according to the first embodiment of the present disclosure, the control unit may output the target material in the target generator from the nozzle hole in the nozzle by outputting the target material as a jet, and may determine whether or not the difference between the output direction of the target material and the set direction is within the predetermined range by determining whether or not a difference between a trajectory of the target material outputted as a jet and a set trajectory is within a predetermined range.

3.1.2 Configuration

Figure 2:
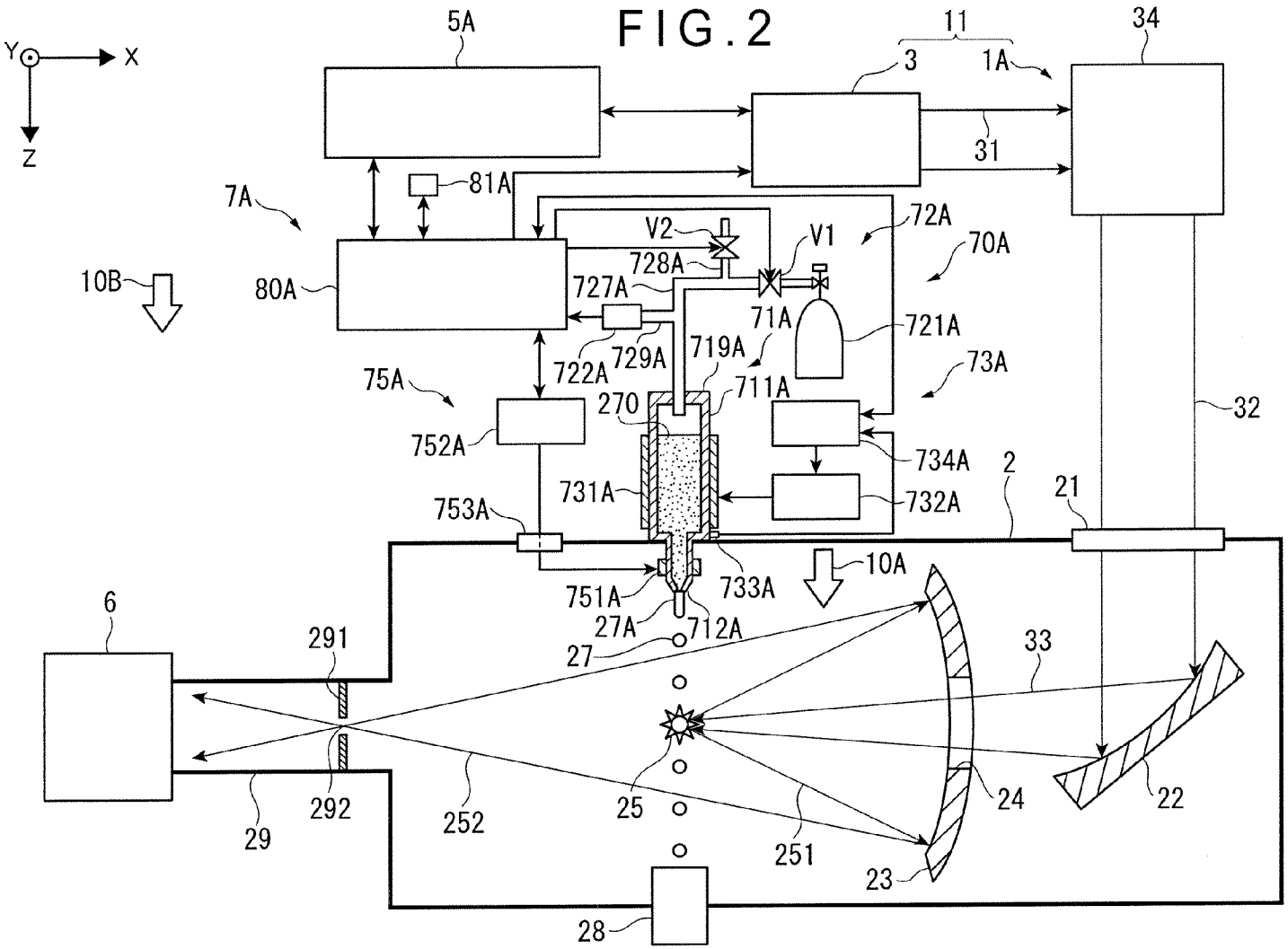
FIG. 2 schematically illustrates the configuration of an EUV light generation apparatus that includes a target supply device according to a first embodiment and a second embodiment.
Figure 3:
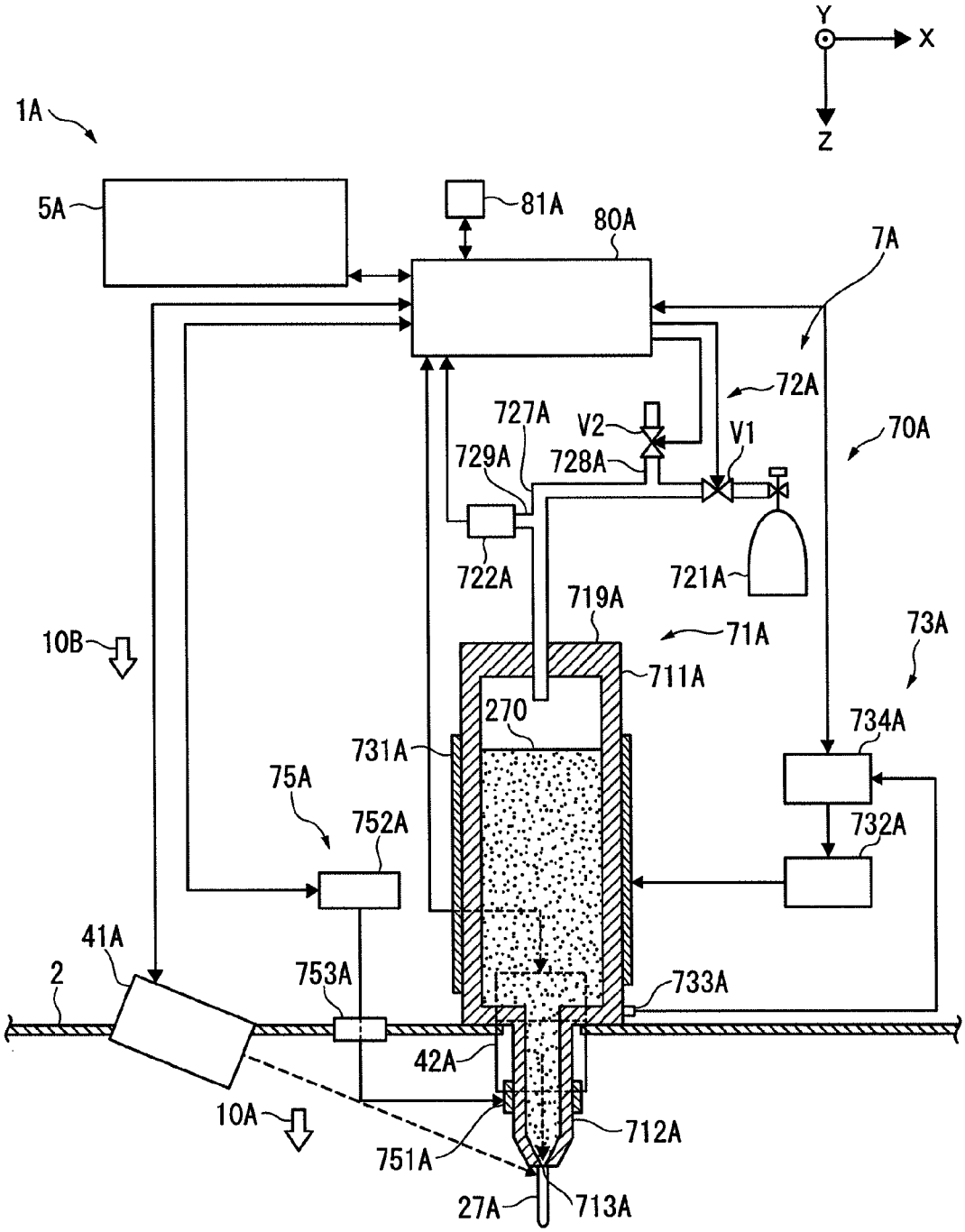
FIG. 3 schematically illustrates the configuration of the target supply device according to the first embodiment.

FIG. 2 schematically illustrates the configuration of an EUV light generation apparatus that includes the target supply device according to the first embodiment as well as a second embodiment that will be described later. FIG. 3 schematically illustrates the configuration of the target supply device according to the first embodiment.

An EUV light generation apparatus 1A may, as shown in FIG. 2, include the chamber 2 and a target supply device 7A. The target supply device 7A may include a target generation section 70A and a target control apparatus 80A. The laser apparatus 3 and an EUV light generation controller 5A may be electrically connected to the target control apparatus 80A.

As shown in FIGS. 2 and 3, the target generation section 70A may include a target generator 71A, a pressure control section 72A, a temperature control section 73A, and a piezoelectric section 75A.

The target generator 71A may include a tank 711A for holding a target material 270 in its interior. The tank 711A may be cylindrical in shape. A nozzle 712A for outputting the target material 270 in the tank 711A to the chamber 2 as the targets 27 may be provided in the tank 711A. The target generator 71A may be provided so that the tank 711A is positioned outside of the chamber 2 and the nozzle 712A is positioned inside of the chamber 2.

It is preferable for the nozzle 712A to be configured of a material that has a low wettability with the target material 270. A "material that has a low wettability to the target material 270" may specifically be a material whose angle of contact with the target material 270 is greater than 90°. The material having an angle of contact greater than or equal to 90° may be one of SiC, $SiO_2$, $Al_2O_3$, molybdenum, tungsten, and tantalum.

Figure 4A:
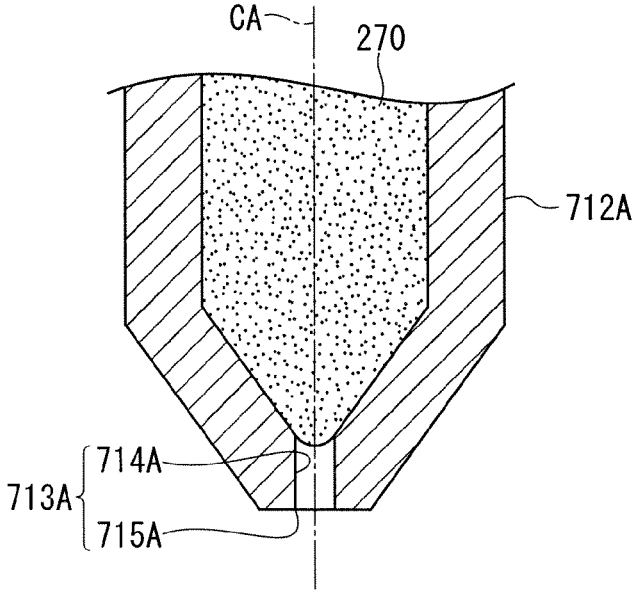
FIG. 4A is a diagram illustrating an issue in the first embodiment, and illustrates a state in which the target supply device is not outputting a jet.

A nozzle hole 713A of the nozzle 712A may have an inner wall surface 714A (see FIG. 4A) and an opening 715A (see FIG. 4A). The inner wall surface 714A may be formed in a cylindrical shape so that an axis of the nozzle hole 713A matches an axis of the nozzle 712A. The opening 715A may be provided at a first end of the nozzle hole 713A.

Depending on how the chamber 2 is arranged, it is not necessarily the case that a pre-set output direction for the target 27 (the axial direction of the nozzle 712A (called a "set output direction 10A")) will match a gravitational direction 10B. The configuration may be such that the target 27 is outputted horizontally or at an angle relative to the gravitational direction 10B. Note that the first embodiment describes a case in which the chamber 2 may be arranged so that the set output direction 10A and the gravitational direction 10B match.

As shown in FIGS. 2 and 3, an inert gas bottle 721A may be connected, via a pipe 727A, to an end 719A of the tank 711A. The pipe 727A may be connected at a first end to the inert gas bottle 721A. The pipe 727A may be connected to the end 719A so that a second end of the pipe 727A is located within the tank 711A. Through such a configuration, an inert gas within the inert gas bottle 721A can be supplied to the interior of the target generator 71A.

The pressure control section 72A may be provided in the pipe 727A. The pressure control section 72A may include a first valve V1, a second valve V2, and a pressure sensor 722A.

The first valve V1 may be provided in the pipe 727A.

A pipe 728A may be connected to a location of the pipe 727A that is closer to the tank 711A than the first valve V1. The pipe 728A may be connected at a first end to a side surface of the pipe 727A. A second end of the pipe 728A may be open. The second valve V2 may be provided partway along the pipe 728A.

The first valve V1 and the second valve V2 may be gate valves, ball valves, butterfly valves, or the like. The first valve V1 and the second valve V2 may be the same type of valve, or may be different types of valves.

The target control apparatus 80A may be electrically connected to the first valve V1 and the second valve V2. The first valve V1 and the second valve V2 may switch, independent from each other, between open and closed states based on a signal sent from the target control apparatus 80A.

When the first valve V1 opens, an inert gas from the inert gas bottle 721A can be supplied to the interior of the target generator 71A via the pipe 727A. When the second valve V2 closes, the inert gas present in the pipe 727A can be prevented from being discharged to the exterior of the pipe 727A from the second end of the pipe 728A. Accordingly, when the first valve V1 opens and the second valve V2 closes, a pressure in the target generator 71A can rise to the same pressure as the pressure in the inert gas bottle 721A. Thereafter, the pressure in the target generator 71A can be held at the same pressure as the pressure in the inert gas bottle 721A.

When the first valve V1 closes, an inert gas from the inert gas bottle 721A can be prevented from being supplied to the interior of the target generator 71A via the pipe 727A. When the second valve V2 opens, the inert gas present in the pipe 727A can be discharged to the exterior of the pipe 727A from the second end of the pipe 728A as a result of a pressure difference between the interior of the pipe 727A and the exterior of the pipe 727A. Accordingly, when the first valve V1 closes and the second valve V2 opens, the pressure in the target generator 71A can drop.

A pipe 729A may be connected to a location of the pipe 727A that is closer to the tank 711A than the pipe 728A. The pipe 729A may be connected at a first end to a side surface of the pipe 727A. The pressure sensor 722A may be provided in a second end of the pipe 729A. The target control apparatus 80A may be electrically connected to the pressure sensor 722A. The pressure sensor 722A may detect a pressure of the inert gas present in the pipe 729A and may send a signal corresponding to the detected pressure to the target control apparatus 80A. The pressure within the pipe 729A can be essentially the same as the pressure in the pipe 727A and the pressure in the target generator 71A.

The temperature control section 73A may be configured to control the temperature of the target material 270 within the tank 711A. The temperature control section 73A may include a heater 731A, a heater power source 732A, a temperature sensor 733A, and a temperature controller 734A. The heater 731A may be provided on an outer circumferential surface of the tank 711A. The heater power source 732A may cause the heater 731A to produce heat by supplying power to the heater 731A based on a signal from the temperature controller 734A. As a result, the target material 270 within the tank 711A can be heated via the tank 711A.

The temperature sensor 733A may be provided on the outer circumferential surface of the tank 711A, toward the location of the nozzle 712A, or may be provided within the tank 711A. The temperature sensor 733A may be configured to detect a temperature primarily at a location where the temperature sensor 733A is installed as well as the vicinity thereof in the tank 711A, and to send a signal corresponding to the detected temperature to the temperature controller 734A. The temperature at the location where the temperature sensor 733A is installed and at the vicinity thereof can be essentially the same temperature as the temperature of the target material 270 within the tank 711A.

The temperature controller 734A may be configured to output, to the heater power source 732A, a signal for controlling the temperature of the target material 270 to a predetermined temperature, based on a signal from the temperature sensor 733A.

The piezoelectric section 75A may include a piezoelectric element 751A and a power source 752A. The piezoelectric element 751A may be provided on an outer circumferential surface of the nozzle 712A within the chamber 2. Instead of the piezoelectric element 751A, a mechanism capable of applying vibrations to the nozzle 712A at high speeds may be provided. The power source 752A may be electrically connected to the piezoelectric element 751A via a feedthrough 753A. The power source 752A may be electrically connected to the target control apparatus 80A.

The target generation section 70A may generate a jet 27A as a continuous jet, and may be configured so that the targets 27 are produced by vibrating the jet 27A outputted from the nozzle 712A.

As shown in FIG. 3, a first target sensor 41A and a second target sensor 42A may be provided in the chamber 2. The first target sensor 41A and the second target sensor 42A may correspond to an image sensor of the present disclosure.

The first target sensor 41A may be provided to the side of the target generator 71A in a −X direction (in FIG. 3, the left side). The second target sensor 42A may be provided to the side of the target generator 71A in a −Y direction (in FIG. 3, the far side in the depth direction). The first target sensor 41A and the second target sensor 42A may be provided so as to be capable of detecting the jet 27A outputted from the nozzle 712A, from the −X direction and the −Y direction, respectively.

The first target sensor 41A and the second target sensor 42A may be electrically connected to the target control apparatus 80A. The first target sensor 41A and the second target sensor 42A may respectively send, to the target control apparatus 80A, signals corresponding to a detected form of the jet 27A.

The target control apparatus 80A may serve as a controller according to the present disclosure. A timer 81A may be electrically connected to the target control apparatus 80A. The target control apparatus 80A may control the temperature of the target material 270 in the target generator 71A by sending a signal to the temperature controller 734A. The target control apparatus 80A may control the pressure in the target generator 71A by sending signals to the first valve V1 and the second valve V2 of the pressure control section 72A.

3.1.3 Operation

Figure 4B:
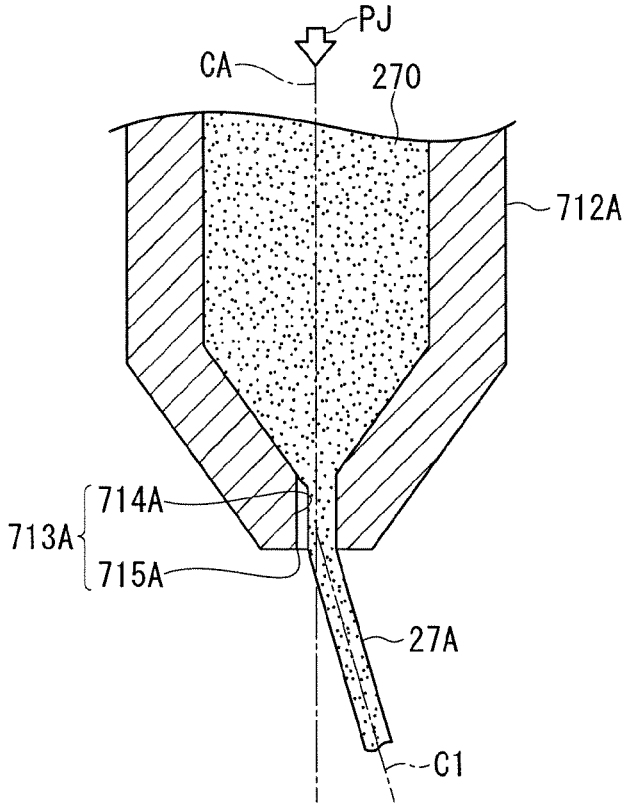
FIG. 4B is a diagram illustrating the stated issue, and illustrates a state in which the target supply device is outputting a jet.
Figure 5:
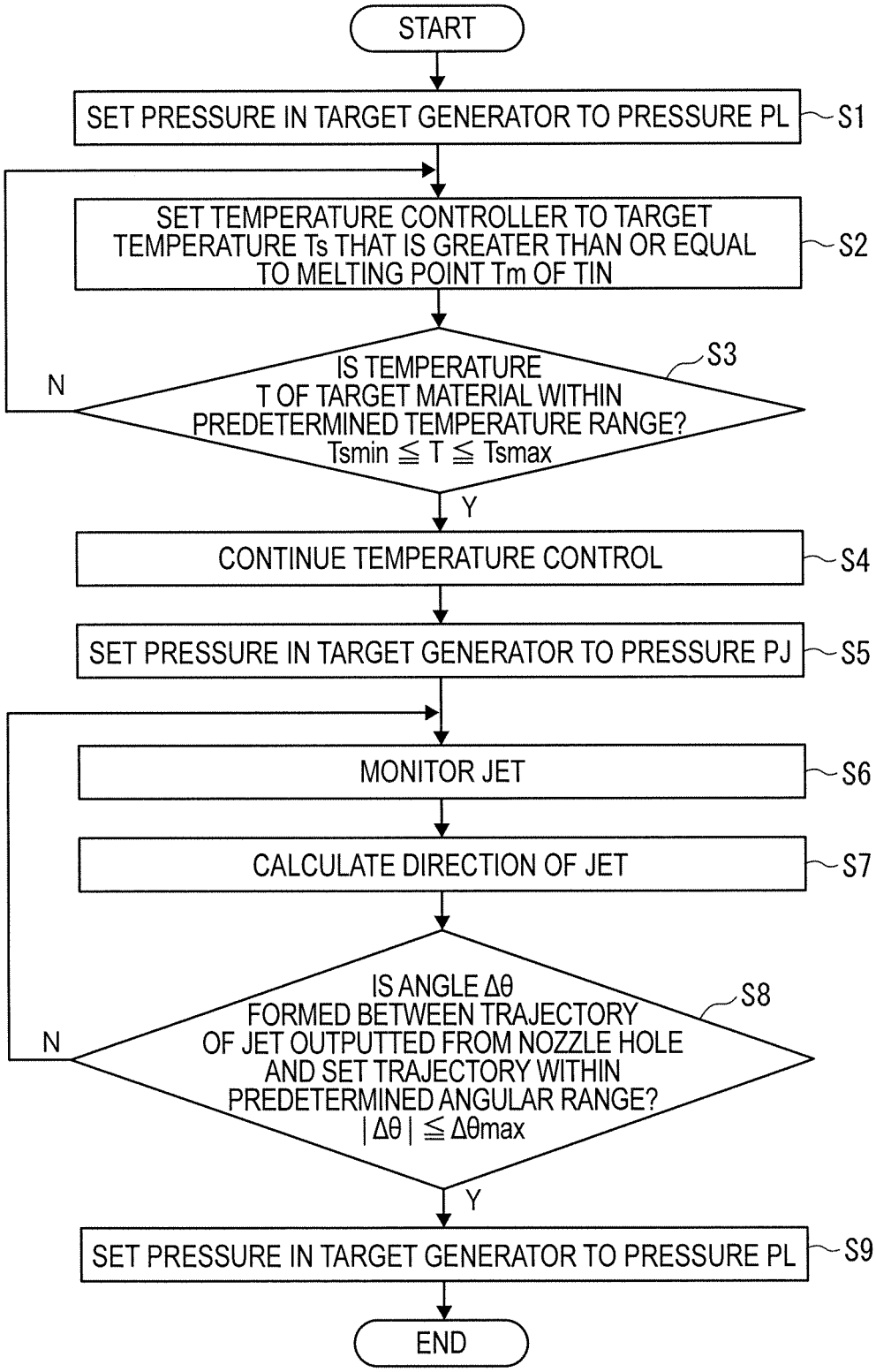
FIG. 5 is a flowchart illustrating a control method for the target supply device.
Figure 6:
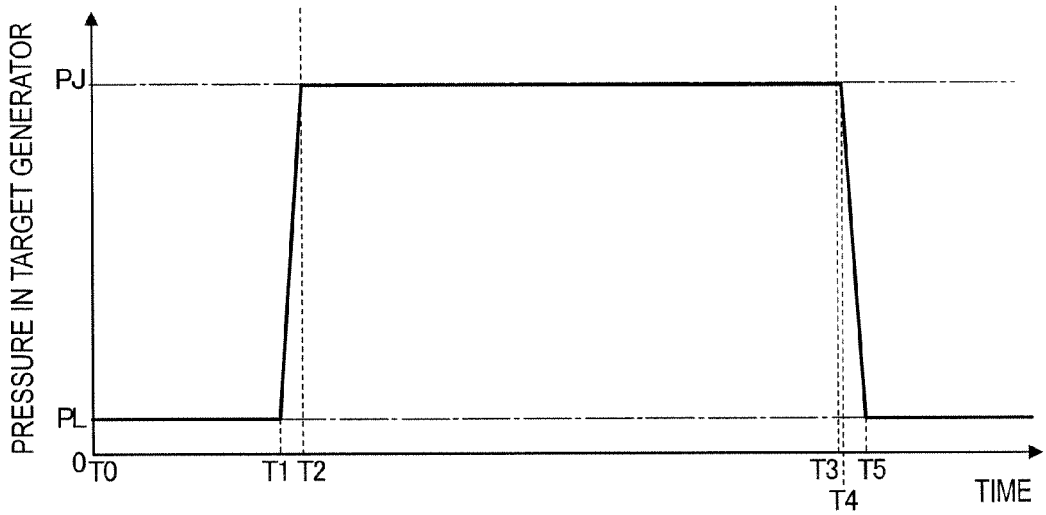
FIG. 6 is a timing chart illustrating the control method for the target supply device.
Figure 7A:
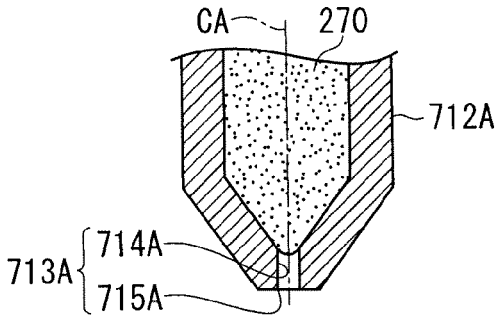
FIG. 7A illustrates a state in which the target supply device is not outputting a jet.
Figure 7B:
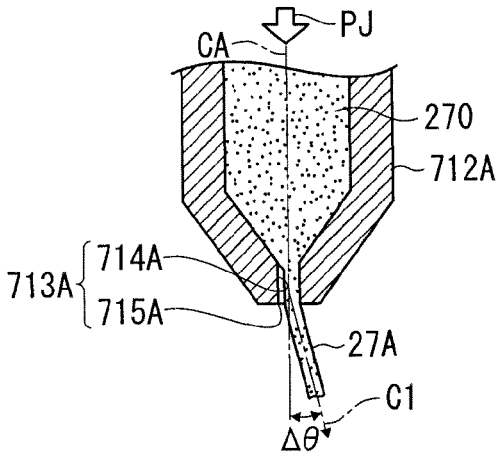
FIG. 7B is a diagram illustrating a state in which the target supply device is outputting a jet, and illustrates a state in which a trajectory of the jet deviates from a set trajectory.
Figure 7C:
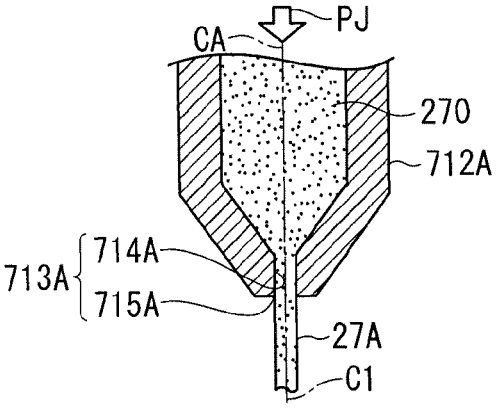
FIG. 7C is a diagram illustrating a state in which the target supply device is outputting a jet, and illustrates a state in which a trajectory of the jet essentially matches the set trajectory.
Figure 7D:
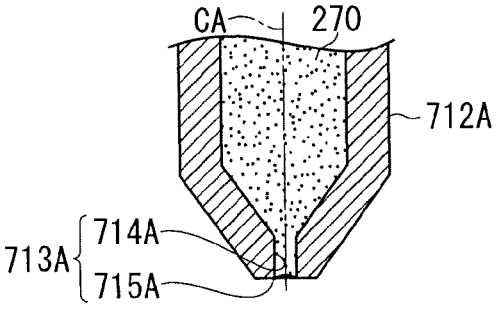
FIG. 7D illustrates a state in which the output of a jet has been stopped from the state shown in FIG. 7C.

FIG. 4A is a diagram illustrating an issue in the first embodiment, and illustrates a state in which the target supply device is not outputting a jet. FIG. 4B is a diagram illustrating the stated issue, and illustrates a state in which the target supply device is outputting the jet. FIG. 5 is a flowchart illustrating a control method for the target supply device. FIG. 6 is a timing chart illustrating the control method for the target supply device. FIG. 7A illustrates a state in which the target supply device is not outputting the jet. FIG. 7B is a diagram illustrating a state in which the target supply device is outputting the jet, and illustrates a state in which a trajectory of the jet deviates from a set trajectory. FIG. 7C is a diagram illustrating a state in which the target supply device is outputting the jet, and illustrates a state in which the trajectory of the jet essentially matches the set trajectory. FIG. 7D illustrates a state in which the output of the jet has been stopped from the state shown in FIG. 7C.

Note that the following describes a control method for the target supply device 7A using a case where the target material 270 is tin as an example. The target control apparatus 80A may receive a signal sent from the pressure sensor 722A and determine a pressure within the target generator 71A based on the received signal. The target control apparatus 80A may receive a signal sent from the timer 81A and determine a time based on the received signal.

First, an issue that the control method for the target supply device of the first embodiment solves will be described.

An operator of the EUV light generation apparatus 1 may install a new target generator 71A, or a target generator 71A that has undergone maintenance, in the chamber 2.

The target control apparatus 80A of the target supply device 7A may, as indicated in FIG. 4A, heat the target material 270 until the target material 270 melts by controlling the temperature control section 73A. The target control apparatus 80A may set the pressure in the target generator 71A to a pressure PJ in order to output the jet 27A. The pressure PJ may be greater than or equal to 1 MPa and less than or equal to 10 MPa. When the pressure in the target generator 71A reaches the pressure PJ, the jet 27A can be outputted from the nozzle hole 713A of the nozzle 712A as indicated in FIG. 4B.

At this time, a trajectory C1 of the jet 27A may deviate from a set trajectory CA. The set trajectory CA may be set to match the center axis of the nozzle 712A. A reason why the trajectory C1 deviates from the set trajectory CA can be postulated as follows.

When the target material 270 is pushed out under the pressure in the target generator 71A from the state shown in FIG. 4A, the inner wall surface 714A of the nozzle 712A can have a region that makes contact with the target material 270 and a region that does not make contact with the target material 270. In this case, the region of the inner wall surface 714A that has made contact with the target material 270 can be more easily wetted by the target material 270. As a result, it is possible for the target material 270 to traverse only part of the inner wall surface 714A and reach only part of the opening 715A. For example, it is possible for the target material 270 to traverse only a region of the inner wall surface 714A that is on the right side shown in FIG. 4B and reach only a region of the opening 715A that is on the right side. When the target material 270 that has reached only the region on the right side is then outputted as the jet 27A, the trajectory C1 of the jet 27A may deviate to the right from the set trajectory CA.

If the target control apparatus 80A then applies vibrations to the nozzle 712A by controlling the piezoelectric section 75A while the jet 27A whose trajectory C1 has deviated from the set trajectory CA is being outputted, the targets 27 generated by the vibrations may be outputted in an unintended direction.

To solve such an issue, the control method for the target supply device 7A shown in FIGS. 5 and 6 may be carried out before starting the process for outputting the targets 27 in order to generate the EUV light.

With the nozzle 712A located within the chamber 2 and the interior of the chamber 2 being in a vacuum state, the target control apparatus 80A of the target supply device 7A may perform a process such as that shown in FIG. 5 as a pre-process for the process carried out to generate the targets 27.

The target control apparatus 80A may set the pressure in the target generator 71A to a pressure PL (step S1). The target control apparatus 80A may adjust the apertures of the first valve V1 and the second valve V2 of the pressure control section 72A by sending signals to the first valve V1 and the second valve V2. Through this, the inert gas in the inert gas bottle 721A can be supplied to the target generator 71A, and the pressure in the target generator 71A can rise to the pressure PL at a time T0, as shown in FIG. 6. The pressure PL may be of a magnitude that positions an end area of the target material 270 at the opposite end of the nozzle hole 713A to the end on which the opening 715A is located (that is, an upper end), as shown in FIG. 7A. The pressure PL may, for example, be less than or equal to atmospheric pressure, and may be 0.05 MPa.

As shown in FIG. 5A, the target control apparatus 80A may set the temperature controller 734A to a target temperature Ts that is greater than or equal to a melting point Tm of tin (step S2). The melting point Tm of tin may be 232° C. The target temperature Ts may be, for example, 280° C. to 350° C. As a result of the processing indicated in step S2, a temperature T of the target material 270 in the target generator 71A can rise.

The target control apparatus 80A may determine whether or not the temperature T of the target material 270 within the target generator 71A is within a predetermined temperature range (step S3). The predetermined temperature range may be greater than or equal to a minimum temperature Tsmin and less than or equal to a maximum temperature Tsmax. The target temperature Ts, corresponding to a median value of the predetermined temperature range, may be 315° C.

When it is determined in step S3 that the standard for determination has been met, the target control apparatus 80A may continue this temperature control as-is (step S4). However, when it is determined in step S3 that the standard for determination has not been met, the target control apparatus 80A may carry out the process of step S2. When the process of step S2 is carried out, in the case where the temperature T is lower than the minimum temperature Tsmin, the temperature of the target material 270 can rise. In the case where the temperature T is higher than the maximum temperature Tsmax, the temperature of the target material 270 can drop.

The target control apparatus 80A may set the pressure in the target generator 71A to the pressure PJ (step S5). The target control apparatus 80A may adjust the apertures of the first valve V1 and the second valve V2 by sending signals to the first valve V1 and the second valve V2. The pressure PJ may be of a magnitude that outputs the target material 270 in the target generator 71A from the nozzle 712A as the jet 27A. As described above, the pressure PJ may be greater than or equal to 1 MPa and less than or equal to 10 MPa.

When the process of step S5 is carried out, the pressure in the target generator 71A can begin to rise at a time T1 and reach the pressure PJ at a time T2, as indicated in FIG. 6. When the pressure in the target generator 71A reaches the pressure PJ, the target material 270 can be pressurized and the jet 27A can be outputted from the nozzle hole 713A as indicated in FIG. 7B. At this time, as described above, the trajectory C1 of the jet 27A may deviate from the set trajectory CA.

The first target sensor 41A and the second target sensor 42A may monitor the jet 27A as indicated in FIG. 5 (step S6). The first target sensor 41A and the second target sensor 42A can monitor (detect) the jet 27A from the −X direction and the −Y direction, respectively. The first target sensor 41A and the second target sensor 42A may respectively send, to the target control apparatus 80A, signals corresponding to monitoring results (detection results) for the jet 27A.

The target control apparatus 80A may calculate the direction of the jet 27A (step S7). Based on the signals sent from the first target sensor 41A and the second target sensor 42A, the target control apparatus 80A may calculate an output state of the jet 27A occurring when the jet 27A is monitored from the −X direction and the −Y direction. The target control apparatus 80A may calculate the direction of the jet 27A as the trajectory C1 based on the calculated output state. At this time, the target control apparatus 80A can calculate the direction of the jet 27A at a high level of accuracy based on the monitoring results from the two different directions obtained by the first target sensor 41A and the second target sensor 42A.

The target control apparatus 80A may determine whether or not an angle Δθ formed between the trajectory C1 of the jet 27A outputted from the nozzle hole 713A and the set trajectory CA is within a predetermined angular range (step S8). The determination as to whether or not the angle Δθ is within the predetermined angular range indicated in FIG. 7B may be carried out by determining whether or not the absolute value of the angle Δθ is less than or equal to a threshold angle Δθmax. The threshold angle Δθmax may be several degrees (for example, $0° \leq \Delta\theta max \leq 3°$).

Here, as shown in FIG. 7B, if the output of the jet 27A is continued with the trajectory C1 of the jet 27A deviated from the set trajectory CA, the region of the inner wall surface 714A that makes contact with the target material 270 can gradually spread along the circumferential direction of the nozzle hole 713A. As a result, the target material 270 can make contact with the entire inner wall surface 714A and can reach the entire opening 715A along the entire area of the inner wall surface 714A. When the target material 270 that has reached the entire opening 715A is outputted as the jet 27A, the trajectory C1 of the jet 27A can essentially match the set trajectory CA, as indicated in FIG. 7C. In other words, the absolute value of the angle Δθ can be essentially zero.

When it is determined that the standard for determination in step S8 has not been met, the target control apparatus 80A may carry out the process of step S6, as indicated in FIG. 5. For example, in the case where the jet 27A is being outputted in the manner indicated in FIG. 7B, it can be determined that the angle Δθ is not within the predetermined angular range.

On the other hand, in the case where it has been determined that the standard for the determination in step S8 is met, the target control apparatus 80A may set the pressure in the target generator 71A to the pressure PL (step S9). For example, the target control apparatus 80A can determine that the angle Δθ is within the predetermined angular range in the case where the jet 27A is being outputted in the manner indicated in FIG. 7C at a time T3 indicated in FIG. 6.

When the process of step S9 is carried out, the pressure in the target generator 71A can begin to drop at a time T4 and reach the pressure PL at a time T5, as indicated in FIG. 6. During the period leading up to the pressure in the target generator 71A reaching the pressure PL, the output of the jet 27A can be stopped with the target material 270 making contact with the entire inner wall surface 714A, as indicated in FIG. 7D.

After this, the target control apparatus 80A may generate the targets 27 by controlling the target generation section 70A, in order to generate the EUV light. Here, because the entire inner wall surface 714A is more easily wetted by the target material 270 as a result of the aforementioned control method for the target supply device 7A, the output of the jet 27A can be started with the target material 270 making contact with the entire inner wall surface 714A, as indicated in FIG. 7D. As a result, the jet 27A can be outputted with the trajectory C1 thereof essentially matching the set trajectory CA, and the targets 27 can be outputted in an intended direction (that is, toward the plasma generation region 25).

As described thus far, the target control apparatus 80A performs, as a pre-process for the process for outputting the targets 27, a process for holding the pressure in the target generator 71A at the pressure PJ until a difference between the output direction of the target material 270 outputted from the nozzle hole 713A and a set direction falls within a predetermined range, and thus the targets 27 can be properly outputted after the pre-process has been carried out.

The targets 27 can be properly outputted as a continuous jet by the target control apparatus 80A determining whether or not the angle Δθ formed between the trajectory C1 of the jet 27A and the set trajectory CA is within the predetermined angular range.

3.2 Second Embodiment

3.2.1 Overview

In a control method for a target supply device according to a second embodiment of the present disclosure, the output of the target material in the target generator from the nozzle hole in the nozzle may be carried out by pushing out the target material from the nozzle hole and causing the target material to adhere to a leading end of the nozzle, and the determination as to whether or not the difference between the output direction of the target material and the set direction is within the predetermined range may be carried out by determining whether or not a difference between a center position of the target material that adheres to the leading end of the nozzle and a center axis of the nozzle hole is within a predetermined range.

In a target supply device according to the second embodiment of the present disclosure, the control unit may output the target material in the target generator from the nozzle hole in the nozzle by pushing out the target material from the nozzle hole and causing the target material to adhere to a leading end of the nozzle, and may determine whether or not the difference between the output direction of the target material and the set direction is within the predetermined range by determining whether or not a difference between a center position of the target material that adheres to the leading end of the nozzle and a center axis of the nozzle hole is within a predetermined range.

3.2.2 Configuration

Figure 8:
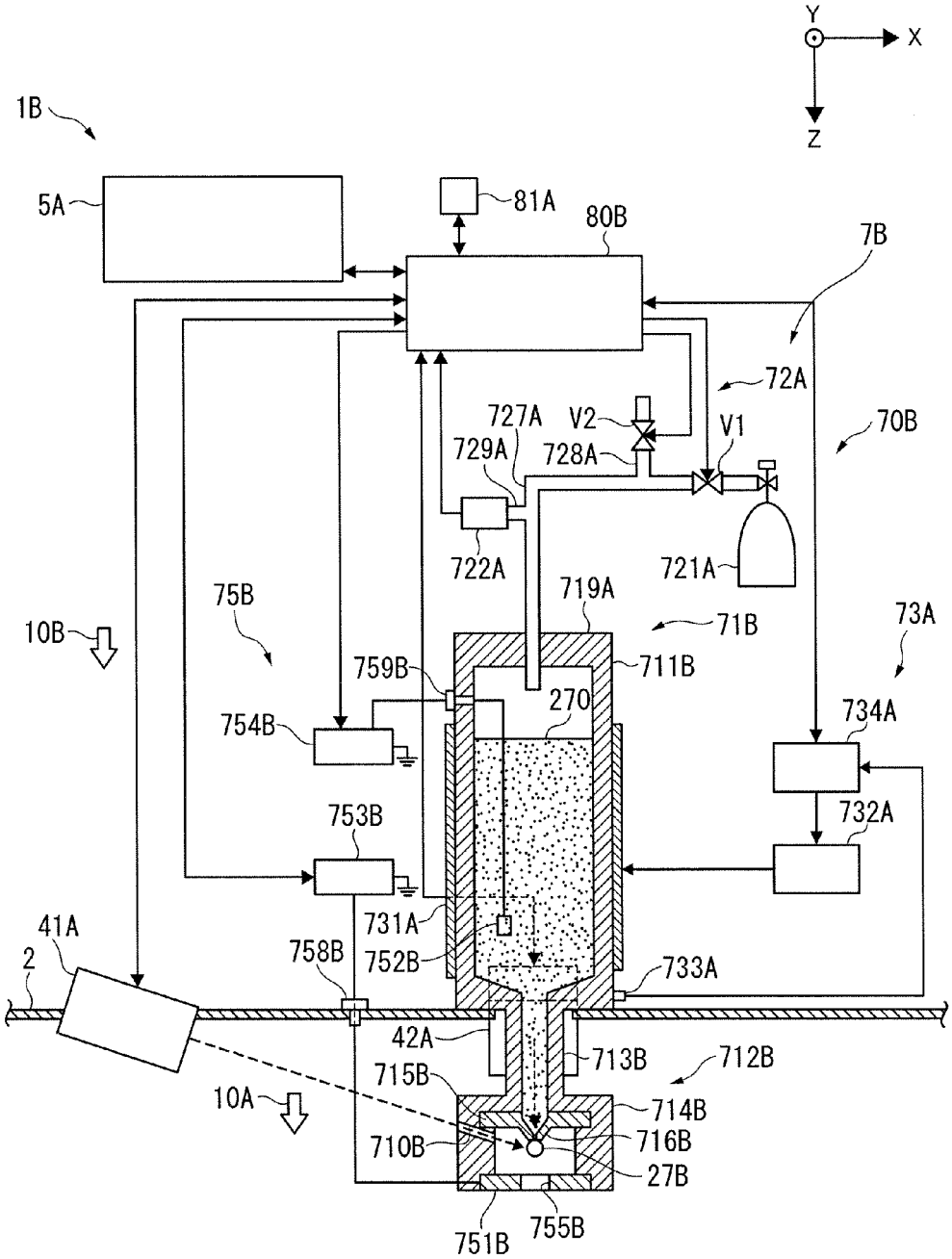
FIG. 8 schematically illustrates the configuration of the target supply device according to the second embodiment.
Figure 9:
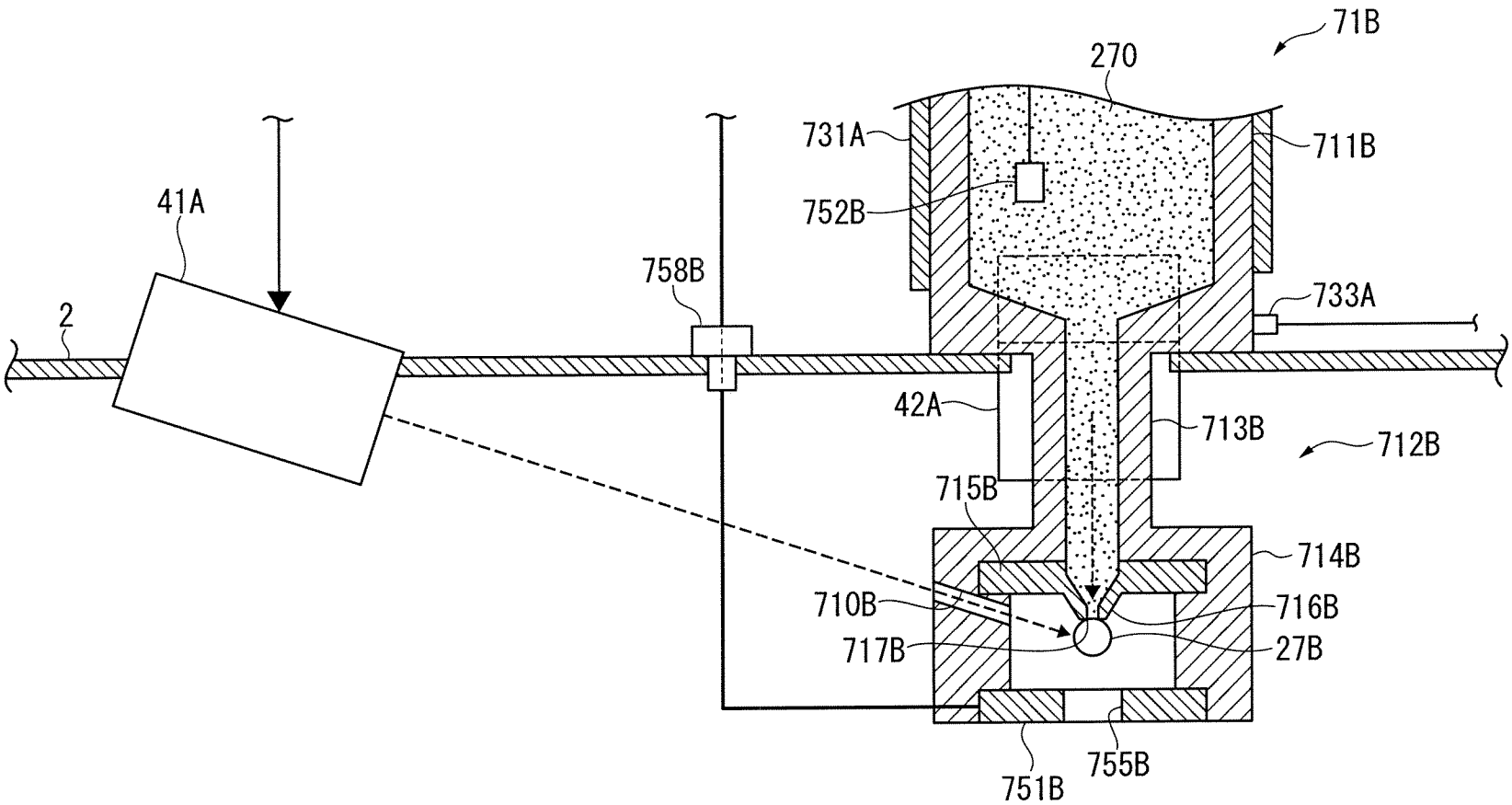
FIG. 9 schematically illustrates the configuration of a nozzle in the target supply device.

FIG. 8 schematically illustrates the configuration of the target supply device according to the second embodiment. FIG. 9 schematically illustrates the configuration of a nozzle in the target supply device.

As shown in FIG. 8, an EUV light generation apparatus 1B according to the second embodiment may employ the same configuration as the EUV light generation apparatus 1A of the first embodiment, with the exception of a target generation section 70B of a target supply device 7B and a target control apparatus 80B.

In the second embodiment, the chamber 2 may be arranged so that the set output direction 10A and the gravitational direction 10B match.

The target generation section 70B may include a target generator 71B, the pressure control section 72A, the temperature control section 73A, and an electrostatic extraction section 75B.

As shown in FIGS. 8 and 9, the target generator 71B may include a tank 711B. The tank 711B may be cylindrical in shape. A nozzle 712B may be provided in the tank 711B. The target generator 71B may be provided so that the tank 711B is positioned outside of the chamber 2 and the nozzle 712B is positioned inside of the chamber 2.

The nozzle 712B may include a nozzle main body 713B, a holding portion 714B, and an output portion 715B. The nozzle main body 713B may be provided so as to protrude into the chamber 2 from a lower surface of the tank 711B. The holding portion 714B may be provided on a leading end of the nozzle main body 713B. The holding portion 714B may be formed as a cylinder whose diameter is greater than that of the nozzle main body 713B.

The output portion 715B may be formed as an approximately circular plate. The output portion 715B may be held by the holding portion 714B so as to be affixed to a leading end surface of the nozzle main body 713B. A circular truncated cone-shaped protruding portion 716B may be provided in a central area of the output portion 715B. The output portion 715B may be provided so that the protruding portion 716B protrudes into the chamber 2.

The protruding portion 716B may be provided so as to make it easier for an electrical field to concentrate thereon. A nozzle hole 717B may be provided in the protruding portion 716B, in approximately the center of a leading end portion that configures the upper surface of the circular truncated cone in the protruding portion 716B. The diameter of the nozzle hole 717B may be 6 to 15 μm. The nozzle hole 717B may have an inner wall surface 717B1 (see FIG. 10A) and an opening 717B2 (see FIG. 10A). The inner wall surface 717B1 may be formed in a cylindrical shape so that an axis of the nozzle hole 717B matches an axis of the nozzle 712B. The opening 717B2 may be provided at a first end of the inner wall surface 717B1. It is preferable for the output portion 715B to be configured of a material that has a low wettability to the target material 270. Alternatively, at least the surface of the output portion 715B may be coated with a material having a low wettability. The material having a low wettability may be the same material indicated in the first embodiment as the material of the nozzle 712A.

The tank 711B, the nozzle 712B, and the output portion 715B may be configured of electrically insulated materials. In the case where these elements are configured of materials that are not electrically insulated materials, for example, metal materials such as molybdenum, an electrically insulated material may be disposed between the chamber 2 and the target generator 71B, between the output portion 715B and a first electrode 751B (mentioned later), and so on. In this case, the tank 711B and a pulsed voltage generator 753B, mentioned later, may be electrically connected.

Meanwhile, a target 27B may adhere to a leading end of the protruding portion 716B prior to being extracted from the protruding portion 716B by the electrostatic extraction section 75B.

Two through-holes 710B may be provided in the holding portion 714B. The through-holes 710B may be provided so that the target 27B adhering to the leading end of the protruding portion 716B can be monitored by the first target sensor 41A and the second target sensor 42A.

The electrostatic extraction section 75B may include the first electrode 751B, a second electrode 752B, the pulsed voltage generator 753B, and a voltage source 754B. As will be described later, the targets 27B may be extracted from the output portion 715B by utilizing a potential difference between a potential of the first electrode 751B and a potential of the second electrode 752B.

A circular through-hole 755B may be formed in the center of the first electrode 751B. The first electrode 751B may be held by the holding portion 714B so that a gap is formed between the first electrode 751B and the output portion 715B. It is preferable for the first electrode 751B to be held so that a center axis of the through-hole 755B and an axis of the protruding portion 716B match. The targets 27B can pass through the circular through-hole 755B. The first electrode 751B may be electrically connected to the pulsed voltage generator 753B via a feedthrough 758B.

The second electrode 752B may be disposed in the target material 270 within the tank 711B. The second electrode 752B may be electrically connected to the voltage source 754B via a feedthrough 759B.

The pulsed voltage generator 753B and the voltage source 754B may be grounded. The pulsed voltage generator 753B and the voltage source 754B may be electrically connected to the target control apparatus 80B.

3.2.3 Operation

In the following, descriptions of operations identical to those in the first embodiment will be omitted.

Figure 10A:
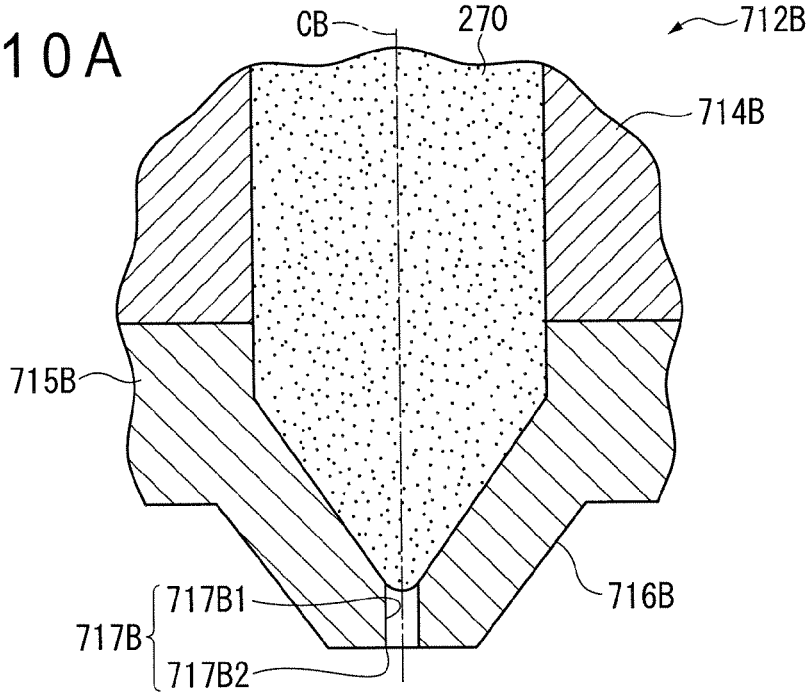
FIG. 10A is a diagram illustrating an issue in the second embodiment, and illustrates a state in which the target supply device is not generating targets.
Figure 10B:
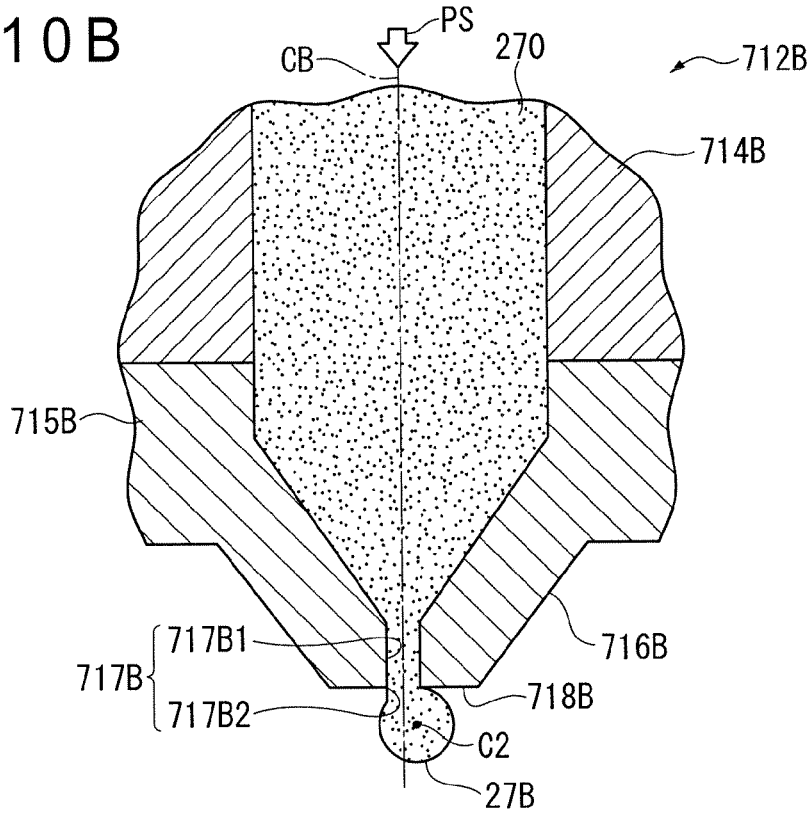
FIG. 10B is a diagram illustrating the stated issue, and illustrates a state prior to a target generated by the target supply device being discharged by an electrostatic extraction section.
Figure 11:
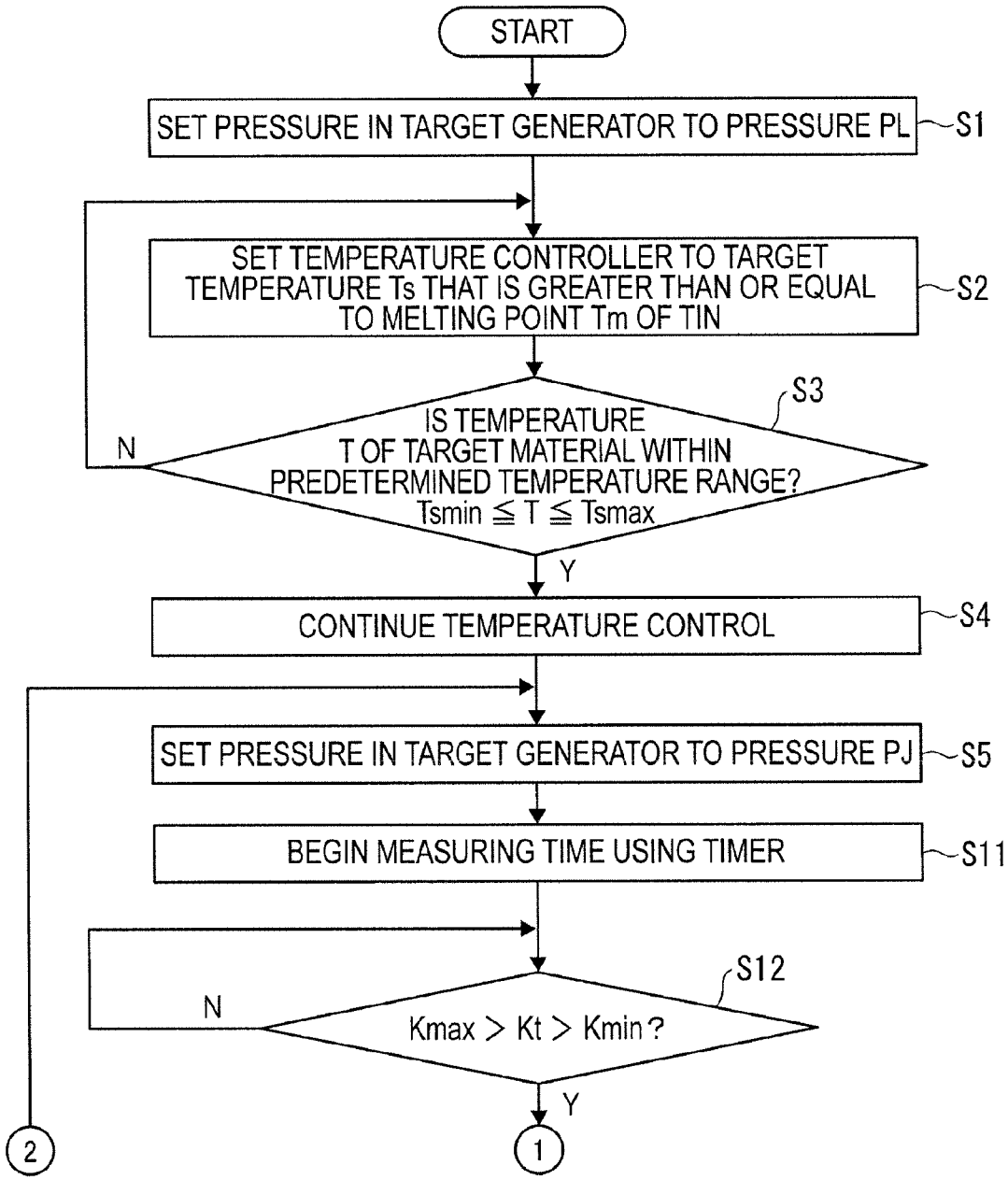
FIG. 11 is a flowchart illustrating a control method for the target supply device.
Figure 12:
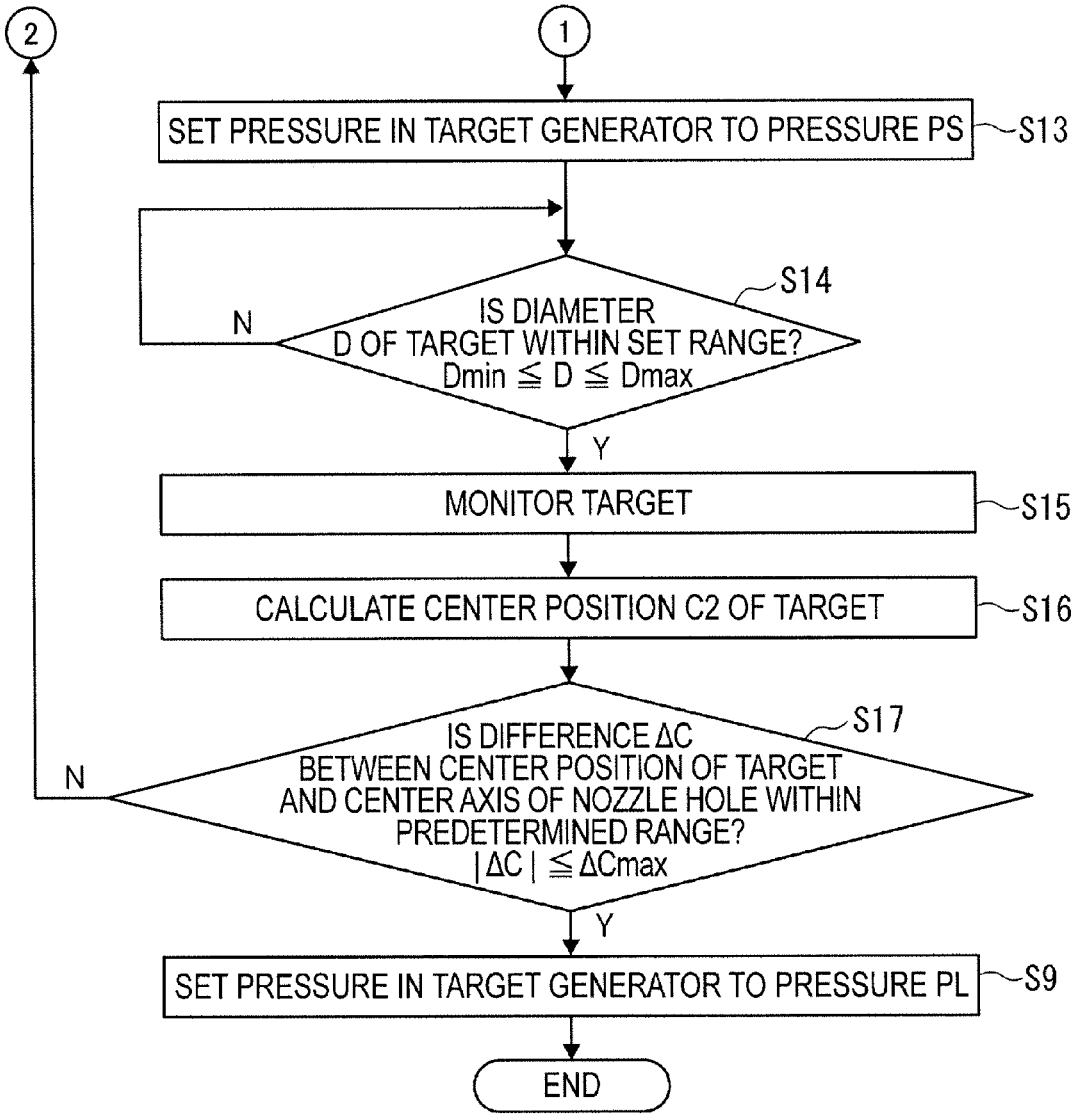
FIG. 12 is a flowchart illustrating the control method for the target supply device, and illustrates a process continuing from that shown in FIG. 11.
Figure 13:
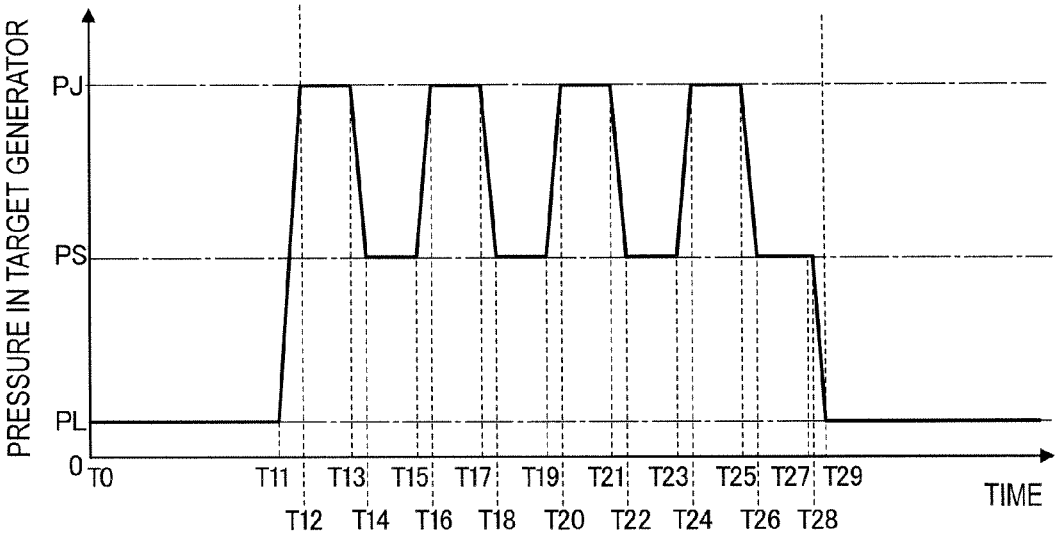
FIG. 13 is a timing chart illustrating a control method for the target supply device.
Figure 14A:
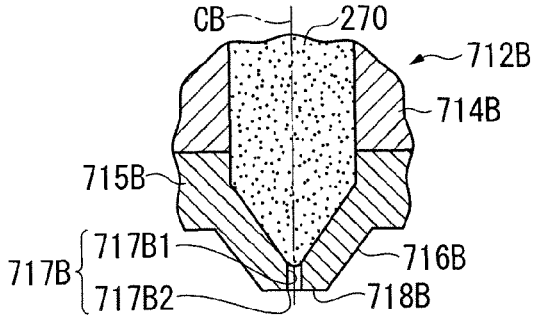
FIG. 14A illustrates a state when the target supply device is not generating targets.
Figure 14B:
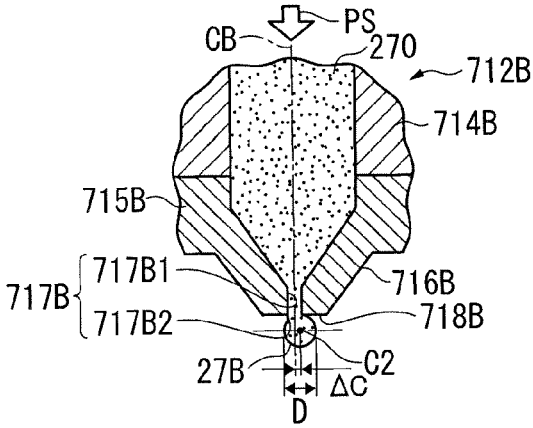
FIG. 14B is a diagram illustrating a state prior to a target generated by the target supply device being discharged by an electrostatic extraction section, and illustrates a state in which a center position of the target deviates from a center axis of a nozzle hole.
Figure 14C:
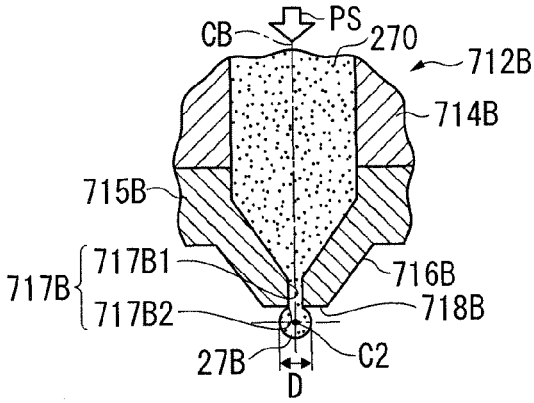
FIG. 14C is a diagram illustrating a state prior to a target generated by the target supply device being discharged by an electrostatic extraction section, and illustrates a state in which a center position of the target essentially matches a center axis of the nozzle hole.
Figure 14D:
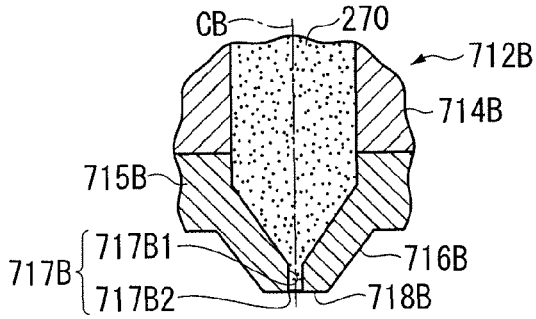
FIG. 14D illustrates a state in which the generation of targets has been stopped from the state shown in FIG. 14C.

FIG. 10A is a diagram illustrating an issue in the second embodiment, and illustrates a state in which the target supply device is not generating targets. FIG. 10B is a diagram illustrating the stated issue, and illustrates a state prior to a target generated by the target supply device being discharged by an electrostatic extraction section. FIG. 11 is a flowchart illustrating a control method for the target supply device. FIG. 12 is a flowchart illustrating the control method for the target supply device, and illustrates a process continuing from the process shown in FIG. 11. FIG. 13 is a timing chart illustrating the control method for the target supply device. FIG. 14A illustrates a state when the target supply device is not generating targets. FIG. 14B is a diagram illustrating a state prior to a target generated by the target supply device being discharged by the electrostatic extraction section, and illustrates a state in which a center position of the target deviates from a center axis of a nozzle hole. FIG. 14C is a diagram illustrating a state prior to a target generated by a target supply device being discharged by an electrostatic extraction section, and illustrates a state in which a center position of the target essentially matches a center axis of a nozzle hole. FIG. 14D illustrates a state in which the generation of targets has been stopped from the state shown in FIG. 14C.

First, an issue that the control method for the target supply device of the second embodiment solves will be described.

After, for example, a new target generator 71B has been installed in the chamber 2, the target control apparatus 80B of the target supply device 7B may, as indicated in FIG. 10A, heat the target material 270 until the target material 270 melts. The target control apparatus 80B may set a pressure in the target generator 71B to a pressure PS in order to generate the targets 27B. When the pressure in the target generator 71B reaches the pressure PS, the target material 270 may break the surface tension of the target material 270 at the nozzle hole 717B. As a result, the target material 270 can be pushed out from the nozzle hole 717B, and the target 27B can be generated at the leading end of the protruding portion 716B, as shown in FIG. 10B. In the case where the nozzle hole 717B is 10 μm in diameter, the pressure PS may be 0.25 MPa.

At this time, a center position C2 of the target 27B may deviate from a center axis CB of the nozzle hole 717B. The center axis CB of the nozzle hole 717B may be set to match the center axis of the nozzle 712B. A reason why the center position C2 deviates from the center axis CB of the nozzle hole 717B can be postulated as follows.

When the target 27B is generated due to the pressure in the target generator 71B, a region that makes contact with the target 27B and a region that does not make contact with the target 27B may be present in a ring-shaped region on the inner edge side of a leading end surface 718B of the protruding portion 716B. In this case, the region, of the ring-shaped region on the inner edge side of the leading end surface 718B, that has made contact with the target 27B can be more easily wetted by the target material 270. As a result, the center position C2 of the target 27B may deviate to the right from the center axis CB of the nozzle hole 717B, for example as indicated in FIG. 10B.

When the target 27B whose center position C2 has deviated from the center axis CB of the nozzle hole 717B is extracted by the electrostatic extraction section 75B, the target 27B may be outputted in an unintended direction.

To solve such an issue, the control method for the target supply device 7B shown in FIGS. 11 and 12 may be carried out before starting the process for extracting the targets 27B in order to generate the EUV light.

The target control apparatus 80B of the target supply device 7B may carry out the same processes as those in steps S1 to S5 according to the first embodiment.

When the process of step S1 is carried out, the pressure in the target generator 71A can rise to the pressure PL at the time T0, as shown in FIG. 13. The pressure PL may be of a magnitude that positions an end area of the target material 270 at the opposite end of the inner wall surface 717B1 in the nozzle hole 717B to the end on which the opening 717B2 is located (that is, the upper end), as shown in FIG. 14A.

When the process of step S5 is carried out, the pressure in the target generator 71B can begin to rise at a time T11 and reach the pressure PJ at a time T12, as indicated in FIG. 13. When the pressure in the target generator 71B reaches the pressure PJ, the target material 270 can be pressurized and a jet (not shown) can be outputted from the nozzle hole 717B.

When the pressure in the target generator 71B reaches the pressure PJ, the target control apparatus 80B may start measuring time using the timer 81A as indicated in FIG. 11 (step S11). The target control apparatus 80B may determine whether or not a measured time Kt measured by the timer 81A is both longer than a minimum time Kmin and shorter than a maximum time Kmax (step S12). The minimum time Kmin and the maximum time Kmax may be several minutes to several tens of minutes. In other words, the length of time from the time T12 to a time T13 (mentioned later) may be several minutes to several tens of minutes.

When it is determined that the standard for determination in step S12 has not been met, the target control apparatus 80B may carryout the process of step S12. In other words, in the case where it has been determined that the standard for the determination in step S12 is not met, the target control apparatus 80B may carry out the process of step S12 again after a predetermined amount of time has elapsed. In the case where it has been determined that the standard for the determination in step S12 is met, the target control apparatus 80B may set the pressure in the target generator 71B to the pressure PS, as indicated in FIG. 12 (step S13).

When the processes of steps S11 to S13 are carried out, the pressure in the target generator 71B can begin to drop at the time T13 and reach the pressure PS at a time T14, as indicated in FIG. 13. The output of the jet can be stopped between the time T13 and the time T14. Furthermore, when the pressure in the target generator 71B reaches the pressure PS, the target 27B can be formed at the leading end of the protruding portion 716B. The target 27B can gradually grow (that is, can gradually develop) while the pressure in the target generator 71B is held at the pressure PS.

The target control apparatus 80B may determine whether or not a diameter D of the target 27B is within a predetermined set range, as indicated in FIG. 12 (step S14). The predetermined set range may be a size at which the entire opening 717B2 of the nozzle hole 717B is covered by the target 27B. The predetermined set range may be greater than or equal to a minimum value Dmin and less than or equal to a maximum value Dmax. The minimum value Dmin may be 100 μm. The maximum value Dmax may be 1 mm.

A method such as that described hereinafter may be employed as a method through which the target control apparatus 80B detects the diameter D of the target 27B.

The first target sensor 41A and the second target sensor 42A may detect the shape of the target 27B that gradually grows, and may respectively send signals corresponding to the detection results to the target control apparatus 80B. The first target sensor 41A and the second target sensor 42A may detect the shape of the target 27B every predetermined amount of time. Based on the signals sent from the first target sensor 41A and the second target sensor 42A, the target control apparatus 80B may determine whether or not the diameter D of the target 27B is within the predetermined set range.

As another method, a relationship between the time required for the pressure in the target generator 71B to reach the pressure PS and the diameter D of the target 27B may be found experimentally. A minimum time at which the diameter D reaches the minimum value Dmin and a maximum time at which the diameter D reaches the maximum value Dmax may then be found based on the results of the experiment, and the minimum and maximum times may then be stored in a memory (not shown). The target control apparatus 80B may use the timer 81A to measure the amount of time that has elapsed after the pressure in the target generator 71B has reached the pressure PS, and when the elapsed time is greater than or equal to the minimum time and less than or equal to the maximum time, the diameter D of the target 27B may be determined to be within the predetermined set range.

However, when the target control apparatus 80B has determined that the standard for determination in step S14 has not been met, the target control apparatus 80B may carry out the process of step S14. In other words, in the case where it has been determined that the standard for the determination in step S14 is not met, the target control apparatus 80B may carry out the process of step S14 again after a predetermined amount of time has elapsed.

In the case where the target control apparatus 80B has determined that the standard for the determination in step S14 has been met, the first target sensor 41A and the second target sensor 42A may monitor the target 27B that adheres to the protruding portion 716B (step S15).

The target control apparatus 80B may calculate the center position C2 of the target 27B based on the monitoring results from the first target sensor 41A and the second target sensor 42A (step S16).

Based on the signals sent from the first target sensor 41A and the second target sensor 42A, the target control apparatus 80B may calculate an adherence position of the target 27B when the target 27B is monitored from the −X direction and the −Y direction. The target control apparatus 80B may calculate the center position C2 of the target 27B based on the calculated adherence position. Here, the target control apparatus 80B can calculate the center position C2 at a high level of accuracy based on the monitoring results from the first target sensor 41A and the second target sensor 42A.

The target control apparatus 80B may determine whether or not a difference ΔC between the center position C2 of the target 27B and the center axis CB of the nozzle hole 717B is within a predetermined range (step S17). The determination as to whether or not the difference ΔC is within the predetermined range indicated in FIG. 14B may be carried out by determining whether or not the absolute value of the difference ΔC is less than or equal to a threshold ΔCmax. The threshold ΔCmax may be several μm.

In the case where it has been determined that the standard for the determination in step S17 has not been met, the target control apparatus 80B may carry out the processes of step S5 and steps S11 to S17 until the standard for the determination has been met.

When the processes of step S5 and steps S11 to S17 have been carried out, the pressure in the target generator 71B can rise from the pressure PS to the pressure PJ from, for example, a time T15 to a time T16, a time T19 to a time T20, and a time T23 to a time T24, as indicated in FIG. 13.

From the time T16 to a time T17, the time T20 to a time T21, and the time T24 to a time T25, the pressure in the target generator 71B can be held at the pressure PJ and the jet can be outputted from the nozzle hole 717B. The target 27B that adheres to the protruding portion 716B can be outputted into the chamber 2 as the jet is outputted.

From the time T17 to a time T18, the time T21 to a time T22, and the time T25 to a time T26, the pressure in the target generator 71B can be reduced from the pressure PJ to the pressure PS and the output of the jet can be stopped.

The target 27B can gradually grow from the time T18 to the time T19, the time T22 to the time T23, and the time T26 to a time T27.

By repeatedly outputting the jet and growing the target 27B in this manner, the target material 270 can gradually spread along the circumferential direction of the leading end surface 718B. As a result, the target material 270 can make contact with the entire ring-shaped region on the inner edge side of the leading end surface 718B, and as shown in FIG. 14C, the target 27B can grow on the protruding portion 716B so that the center position C2 and the center axis CB of the nozzle hole 717B essentially match.

In the case where it has been determined that the standard for the determination in step S17 is met, the target control apparatus 80B may set the pressure in the target generator 71B to the pressure PL, as indicated in FIG. 12 (step S9). For example, in the case where, at the time T27 indicated in FIG. 13, the target 27B adheres to the protruding portion 716B so that the center position C2 and the center axis CB of the nozzle hole 717B essentially match as indicated in FIG. 14C, the target control apparatus 80B can determine that the difference ΔC is within the predetermined range. In the state shown in FIG. 14C, the entire ring-shaped region on the inner edge side of the leading end surface 718B can be easily wetted by the target material 270.

When the process of step S9 is carried out, the pressure in the target generator 71B can begin to drop at a time T28 and reach the pressure PL at a time T29, as indicated in FIG. 13. The target 27B can be pulled into the nozzle hole 717B during the period leading up to the pressure in the target generator 71A reaching the pressure PL, and as shown in FIG. 14D, a state can be achieved in which the target material 270 makes contact with the entire inner wall surface 717B1 of the nozzle hole 717B and the target 27B does not adhere to the protruding portion 716B.

After this, the target control apparatus 80B may continuously extract the targets 27B from the output portion 715B by using the potential difference between the first electrode 751B and the second electrode 752B, in order to generate the EUV light. Here, because the entire ring-shaped region on the inner edge side of the leading end surface 718B is more easily wettable by the target material 270 as a result of the aforementioned control method for the target supply device 7B, the target 27B can be generated at the protruding portion 716B in order for the center position C2 and the center axis CB of the nozzle hole 717B essentially to be matched. As a result, the target 27B can be extracted in an intended direction (that is, toward the plasma generation region 25).

As described above, by the target control apparatus 80B determining whether or not the difference ΔC between the center position C2 of the target 27B and the center axis CB of the nozzle hole 717B is within the predetermined range, the target 27B can be properly outputted in a configuration in which the target 27B is extracted by utilizing the potential difference between the first electrode 751B and the second electrode 752B.

3.3 Variations

Note that the following configurations may be employed as the control method for a target supply device.

In the first embodiment, rather than monitoring the jet 27A using the first target sensor 41A and the second target sensor 42A, vibrations may be applied to the nozzle 712A that is outputting the jet 27A and the targets 27 generated using these vibrations may be monitored. In this case, instead of determining the deviation of the trajectory C1 of the jet 27A relative to the set trajectory CA, the deviation of the trajectory of the targets 27 relative to the set trajectory CA may be determined.

Although two target sensors (the first target sensor 41A and the second target sensor 42A) are provided in the first and second embodiments, one target sensor, or three or more target sensors, may be provided instead.

In the first and second embodiments, the target supply device 7A and the target supply device 7B may cause the target material 270 to harden by lowering the temperature from the states shown in FIGS. 7D and 14D, respectively. After this, the target supply device 7A and the target supply device 7B may heat the target material 270 to melt and output the targets 27, extract the targets 27B, and so on in order to generate the EUV light.

In the first embodiment, an on-demand system that generates targets by using a piezoelectric element or the like to apply a compressive force to the nozzle 712A may be employed as the target supply device.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more".

What is claimed is:

1. A control method for a target supply device provided in an EUV light generation apparatus that includes an image sensor, the target supply device including a target generator having a nozzle and configured to hold a target material and a pressure control unit configured to control a pressure within the target generator, the method comprising:

outputting the target material in the target generator from a nozzle hole in the nozzle by pressurizing the interior of the target generator using the pressure control unit;

determining whether or not a difference between an output direction of the target material outputted from the nozzle hole that is detected by the image sensor and a set direction is within a predetermined range; and holding the pressure in the target generator using the pressure control unit until the difference between the output direction and the set direction falls within the predetermined range.

2. The control method according to claim 1, wherein the outputting of the target material in the target generator from the nozzle hole in the nozzle is carried out by outputting the target material as a jet; and the determining as to whether or not the difference between the output direction of the target material and the set direction is within the predetermined range is carried out by determining whether or not a difference between a trajectory of the target material outputted as a jet and a set trajectory is within a predetermined range.

3. The control method according to claim 1, wherein the outputting of the target material in the target generator from the nozzle hole in the nozzle is carried out by pushing out the target material from the nozzle hole and causing the target material to adhere to a leading end of the nozzle; and the determining as to whether or not the difference between the output direction of the target material and the set direction is within the predetermined range is carried out by determining whether or not a difference between a center position of the target material that adheres to the leading end of the nozzle and a center axis of the nozzle hole is within a predetermined range.

4. A target supply device provided in an EUV light generation apparatus that includes an image sensor, the device comprising:

a target generator including a nozzle and configured to hold a target material;

a pressure control unit configured to control a pressure in the target generator; and a control unit configured to control the pressure control unit and output the target material in the target generator from a nozzle hole in the nozzle by pressurizing the interior of the target generator, determine whether or not a difference between an output direction of the target material outputted from the nozzle hole that is detected by the image sensor and a set direction is within a predetermined range, and hold the pressure in the target generator until the difference between the output direction and the set direction falls within the predetermined range.

5. The target supply device according to claim 4, wherein the control unit is configured to:

output the target material in the target generator from the nozzle hole in the nozzle by outputting the target material as a jet; and determine whether or not the difference between the output direction of the target material and the set direction is within the predetermined range by determining whether or not a difference between a trajectory of the target material outputted as a jet and a set trajectory is within a predetermined range.

6. The device according to claim 4, wherein the control unit is configured to:

output the target material in the target generator from the nozzle hole in the nozzle by pushing out the target material from the nozzle hole and causing the target material to adhere to a leading end of the nozzle; and determine whether or not the difference between the output direction of the target material and the set direction is within the predetermined range by determining whether or not a difference between a center position of the target material that adheres to the leading end of the nozzle and a center axis of the nozzle hole is within a predetermined range.

* * * * *